US007944154B2

(12) United States Patent
Miyamoto et al.

(10) Patent No.: US 7,944,154 B2
(45) Date of Patent: May 17, 2011

(54) FLUORESCENT TUBE POWER SUPPLY AND BACKLIGHT

(75) Inventors: Hitoshi Miyamoto, Daito (JP); Takashi Jinnouchi, Daito (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 367 days.

(21) Appl. No.: 12/181,068

(22) Filed: Jul. 28, 2008

(65) Prior Publication Data

US 2009/0026974 A1 Jan. 29, 2009

(30) Foreign Application Priority Data

Jul. 28, 2007 (JP) ..... 2007-196815

(51) Int. Cl.
*G05F 1/00* (2006.01)

(52) U.S. Cl. ..... 315/291; 315/224; 315/274; 315/307; 315/312

(58) Field of Classification Search ..... 315/247, 315/246, 224, 225, 297, 307–311, 274–279
See application file for complete search history.

(56) References Cited

U.S. PATENT DOCUMENTS 5,572,094 A * 11/1996 Yamashita et al. ..... 315/308
5,914,566 A * 6/1999 Matsumoto et al. ..... 315/82
7,002,305 B2 * 2/2006 Kambara et al. ..... 315/291
2003/0062849 A1 * 4/2003 Prasad et al. ..... 315/224
2007/0040532 A1 * 2/2007 Bae et al. ..... 318/801
2008/0061706 A1 * 3/2008 Johnsen et al. ..... 315/224
2009/0021174 A1 * 1/2009 Feldtkeller et al. ..... 315/117

FOREIGN PATENT DOCUMENTS

JP 55-105712 8/1980
JP 61-144108 7/1986
JP 10-283044 10/1998

OTHER PUBLICATIONS

Patent Abstracts of Japan, Publication No. 10-283044, Publication Date: Oct. 23, 1998, 1 page.
Patent Abstracts of Japan, Publication No. 61-144108, Publication Date: Jul. 1, 1986, 1 page.
Patent Abstracts of Japan, Publication No. 55-105712, Publication Date: Aug. 13, 1980.

* cited by examiner

*Primary Examiner* — Tuyet Thi Vo
(74) *Attorney, Agent, or Firm* — Osha Liang LLP

(57) ABSTRACT

A fluorescent tube power supply including an inverter power supply which outputs a DC voltage, and an inverter which converts an output of the inverter power supply to an AC; wherein a power stabilizing unit for stabilizing a power input to the inverter is arranged between the inverter power supply and the inverter; and a feedback control of the inverter power supply is performed based on an output of the power stabilizing unit. The power stabilizing unit detects a current flowing between the inverter power supply and the inverter, and the feedback control of the inverter power supply is performed based on the current.

2 Claims, 3 Drawing Sheets

FLUORESCENT TUBE POWER SUPPLY AND BACKLIGHT

BACKGROUND OF THE INVENTION

1. Field of the Invention

The present invention relates to a fluorescent tube power supply and a backlight using the fluorescent tube power supply.

2. Description of the Related Art

Voltage and current sometimes change on a demand side due to inconsistency between a supply side that generates power, transmits power, and a demand side on which great change in load occurs. When such change occurs, power of a power supply cannot be sufficiently ensured, and electrical products may not operate properly.

For instance, in a backlight used in a liquid crystal television, a direct current (DC) power supply for converting an output of a domestic commercial power supply to a direct current and an inverter for converting an output of the DC power supply to an alternating current (AC) are used as a power supply circuit. As the power input to the inverter reduces, the brightness of a screen becomes less than the preset brightness. As the power increases, the brightness of the screen becomes more than the preset brightness.

A dispersion of the brightness among backlights occurs when the impedance of the load in an inverter power supply such as the inverter and the fluorescent tube varies even if the input voltage or current, that is, power does not change. In the inverter, variation of the impedance is relatively found in a transformer and a resonance capacitor.

In particular, a discharge tube such as a Cold Cathode Fluorescent Lamp (CCFL) used in the backlight has negative resistance characteristics. That is, the current decreases as the voltage rises, and the current increases as the voltage lowers.

The impedance of the fluorescent tube such as CCFL differs depending on the current-carrying time, and also varies depending on each fluorescent tube.

On the other hand, the luminance of the backlight depends on a tube current or a tube power of the fluorescent tube, and thus a stable current supply or power supply is required for the fluorescent tube.

Under such circumstances, Japanese Laid-Open Patent Publication No. H10-283044 proposes a constant current power supply device in which a current detection resistor interposed in an input/output line of a constant current source is arranged to detect a current, and in which a correction resistor having the same temperature condition as the current detection resistor is arranged to perform temperature compensation.

Japanese Laid-Open Patent Publication No. S61-144108 proposes a constant current circuit for controlling a large current so that it remain a constant value, where a current supplied to a load is detected with voltage across a resistor element, and the detected voltage is fed back to an input side to supply a constant current to the load.

Japanese Laid-Open Patent Publication No. S55-105712 proposes a clip stabilizing circuit comprising a resistor arranged on a line between an input end and an output end, detecting a voltage across the resistor, and feeding back the voltage to an input side, thereby enhancing the accuracy.

SUMMARY OF THE INVENTION

However, since the constant current power supply device disclosed in Japanese Laid-Open Patent Publication No. H10-283044 is a device for flowing a constant current, the power to be output changes when the load changes. Therefore, the power consumption of the load varies when the load varies.

Similarly, since the constant current circuit disclosed in Japanese Laid-Open Patent Publication No. S61-144108 is a circuit for flowing the constant current, the power consumption of the load changes when the load changes.

The clip stabilizing circuit disclosed in Japanese Laid-Open Patent Publication No. S55-105712 achieves constant current by clipping a voltage. Therefore, the relevant circuit is not provided to stabilize the power consumption, where the power to be output becomes small when the load becomes small, and the power to be output becomes large when the load becomes large.

The constant current sources disclosed in Japanese Laid-Open Patent Publication Nos. H10-283044, S61-144108, and S55-105712 are a constant current source for flowing the constant current to the load, where the power consumption of the load changes when the impedance of the load changes. The luminance of the fluorescent tube tends to easily change if such a constant current source is applied to a fluorescent tube power supply. In particular, since the impedance changes greatly in the fluorescent tube, the change in tube power of the fluorescent tube, that is, the change in luminance tends to be large.

In view of such circumstances, the present invention aims to provide a fluorescent tube power supply in which the change in luminance of the fluorescent tube is reduced, and a backlight employing the fluorescent tube power supply.

In order to achieve the above aim, the present invention provides the following technical means.

A fluorescent tube power supply according to the present invention includes an inverter power supply which outputs a DC voltage, and an inverter which converts an output of the inverter power supply to an AC; wherein a power stabilizing unit for stabilizing a power input to the inverter is arranged between the inverter power supply and the inverter; and a feedback control of the inverter power supply is performed based on an output signal of the power stabilizing unit.

Accordingly, the change in power input from the inverter power supply to the inverter reduces and the tube power of the fluorescent tube stabilizes. The change in luminance of the fluorescent tube thus reduces. Since the fluorescent tube has negative resistance characteristics, the tube power tends to easily change and the luminance of the fluorescent tube also tends to easily change, but the power output from the inverter to the fluorescent tube stabilizes if the change in power input to the inverter is stabilized. Thus, the change in luminance of the fluorescent tube reduces.

Furthermore, since the power input to the inverter stabilizes, the variation in luminance of the fluorescent tube due to the variation in characteristics of a transformer, a resonance capacitor, and the like in the inverter reduces.

In the preferable fluorescent tube power supply according to the present invention, the power stabilizing unit detects a current flowing between the inverter power supply and the inverter, and the feedback control of the inverter power supply is performed based on the detected current.

Accordingly, as the current input to the inverter increases, the feedback control is performed so that the power input to the inverter decreases. As the current input to the inverter decreases, the feedback control is performed so that the power input to the inverter increases.

Therefore, stable power supply is carried out even if the impedance of the inverter or the fluorescent tube connected to the output side of the inverter is changed. In particular, since the discharge tube used as the fluorescent tube has negative resistance characteristics, the impedance changes and the variation among fluorescent tubes tends to easily occur, but as the change in power input to the inverter reduces and the relevant power stabilizes, the change in luminance of the fluorescent tube connected to the output side of the inverter reduces.

The change in the input current with respect to the inverter includes not only the change in the input current of the inverter caused by the change in the input voltage of the inverter, but also the change in the input current of the inverter power supply caused by the change in impedance of the load in the inverter power supply such as the inverter and the fluorescent tube. In other words, a case where the impedance of the load decreases and the current increases under a constant voltage is also included.

In the preferable fluorescent tube power supply according to the present invention, the power stabilizing unit includes a resistor connected between the inverter power supply and the inverter, wherein the current flowing between the inverter power supply and the inverter is detected by detecting a voltage across the resistor.

Accordingly, the current can be detected with a relatively simple configuration, and thus the cost lowers.

In the preferable fluorescent tube power supply according to the present invention, the power stabilizing unit detects an output voltage of the inverter power supply, and the feedback control of the inverter power supply is performed based on the output voltage.

Accordingly, the feedback control is performed so that the power input to the inverter decreases when the voltage input to the inverter rises, and the feedback control is performed so that the power input to the inverter increases when the voltage input to the inverter lowers.

The feedback control based on the output voltage of the inverter power supply also includes a case where the input current of the inverter does not increase even if the input voltage to the inverter rises, that is, a case where the impedance of the load increases at substantially the same time as the rise in the input voltage. In such cases, the rise in the input voltage of the inverter cannot be detected by detecting the input current of the inverter, but the power input to the inverter can be stabilized by detecting the output voltage of the inverter power supply.

In particular, since the discharge tube used as the fluorescent tube has negative resistance characteristics, the impedance tends to easily change and the variation among fluorescent tubes also tends to easily occur, but the tube power of the fluorescent tube stabilizes when the change in the voltage input to the inverter, that is, the change in the input power reduces. The change in luminance of the fluorescent tube thus reduces.

In the preferable fluorescent tube power supply according to the present invention, the feedback control is a control of an output current of the inverter power supply.

Accordingly, when the current of the inverter power supply increases or decreases, such current can be controlled and the power can be stabilized, and furthermore, even if the voltage of the inverter power supply fluctuates as described above, the power can be stabilized by increasing or decreasing the current.

A backlight according to the present invention includes the fluorescent tube power supply described above, and a fluorescent tube supplied with power from the fluorescent tube power supply.

In such a backlight, the power input to the inverter stabilizes, and thus the output voltage of the inverter stabilizes, the change and the flickering of luminance of the backlight reduce, and the variation in the luminance among backlights also reduces.

According to the present invention, a fluorescent tube power supply in which the change in luminance of the fluorescent tube is reduced, and a backlight employing the fluorescent tube power supply can be obtained.

DETAILED DESCRIPTION OF THE PREFERRED EMBODIMENTS

An embodiment of the present invention will be described below with reference to the drawings.

Figure 1:
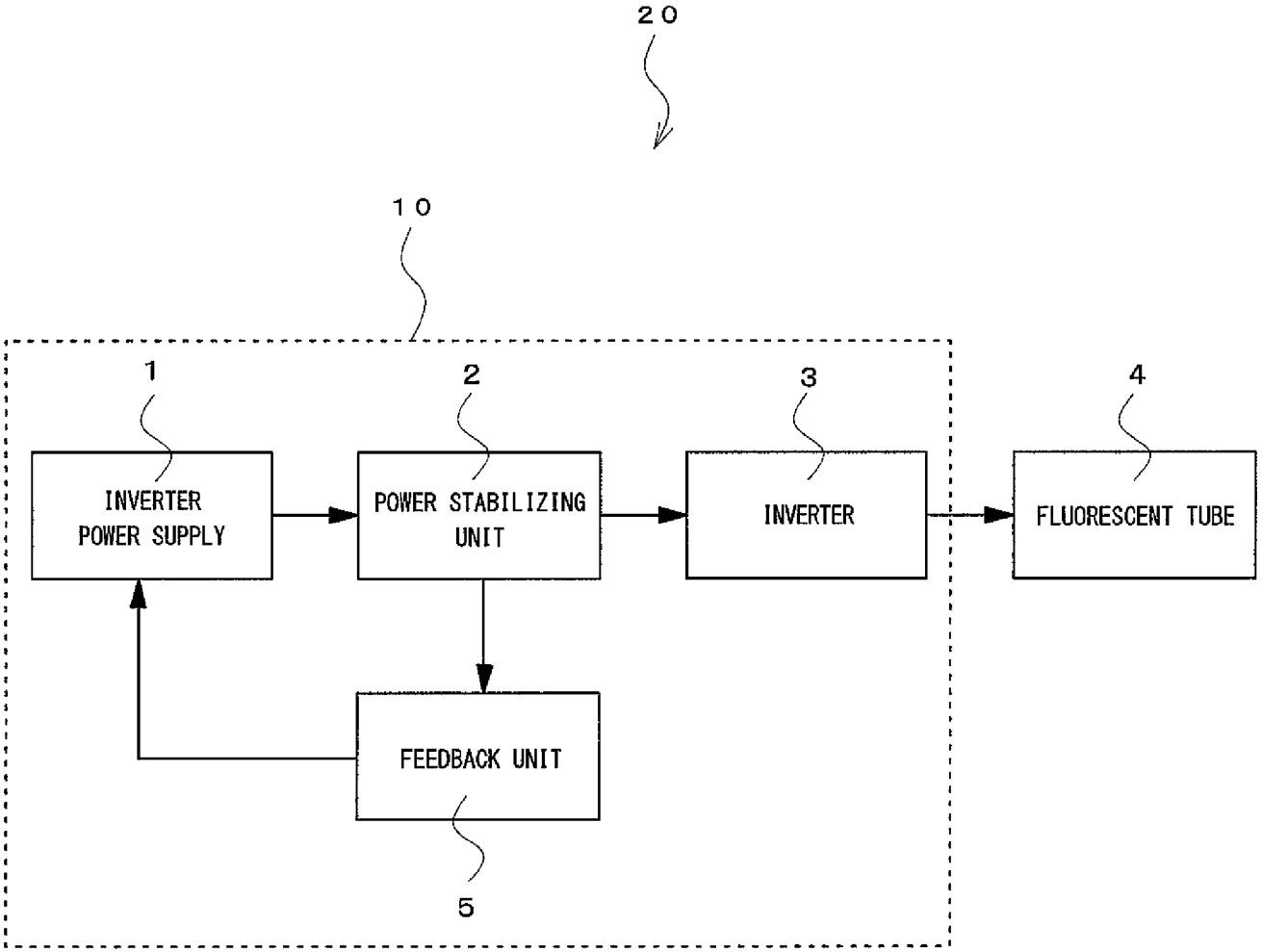
FIG. 1 is a block diagram of a backlight.

FIG. 1 is a block diagram of a backlight according to the embodiment of the present invention. A backlight 20 includes an inverter power supply 1 for converting a domestic commercial power supply, that is, an AC power supply to a DC power supply; a power stabilizing unit 2 for stabilizing an output power of the inverter power supply 1; an inverter 3 supplied with the DC power stabilized in the power stabilizing unit 2; a fluorescent tube 4 supplied with the AC power output from the inverter 3; and a feedback unit 5 for providing a feedback control signal to the inverter power supply 1. The fluorescent tube 4 is a CCFL. The inverter power supply 1, the power stabilizing unit 2, the inverter 3, and the feedback unit 5 configure a fluorescent tube power supply 10.

The inverter power supply 1 is connected to the domestic commercial power supply (not shown) and is a DC power supply for converting an AC to a DC. The power stabilizing unit 2 outputs, to the feedback unit 5, a control signal for reducing the current input to the inverter 3 when the impedance of the inverter 3 or the fluorescent tube 4 decreases and the input current from the inverter power supply 1 increases. In the inverter power supply 1, the output current of the inverter power supply 1 is reduced, and the current flowing to the inverter 3 is reduced based on the control signal provided via the feedback unit 5.

The power stabilizing unit 2 outputs, to the feedback unit 5, a signal for increasing the current input from the inverter power supply 1 to the inverter 3 when the impedance of the load in the inverter power supply 1 such as the inverter 3 and the fluorescent tube 4 increases and the input current from the inverter power supply 1 reduces. In the inverter power supply 1, the current input to the inverter 3 is increased by increasing the output current of the inverter power supply 1 based on the control signal provided via the feedback unit 5. Therefore, the power input to the inverter 3 stabilizes, and the tube power of the fluorescent tube 4 stabilizes.

The fluorescent tube 4 has negative resistance characteristics. When the lighting time i.e. the current flow time of the fluorescent tube 4 changes, the tube current also changes, and thus the luminance changes. However, with the arrangement of the power stabilizing unit 2, the tube power stabilizes even if the impedance of the load of the inverter power supply 1 such as the fluorescent tube 4 is changed by the negative resistance characteristics of the fluorescent tube 4.

Therefore, the luminance of the fluorescent tube 4, which is defined by the tube power, stabilizes. Furthermore, the variation in tube power reduces even if the impedance of the inverter 3 and the fluorescent tube 4 varies among backlights. The flickering of the backlight 20 thus reduces.

The power stabilizing unit 2 provides, to the feedback unit 5, a signal for reducing the current input from the inverter power supply 1 to the inverter 3 when the input voltage of the inverter 3 rises as a result of the rise in the output voltage of the inverter power supply 1. In this case, the output voltage of the inverter power supply 1 is held in the raised state, but the output current decreases, and thus the output power of the inverter power supply 1, that is, the input power of the inverter 3 stabilizes.

Similarly, the power stabilizing unit 2 provides, to the feedback unit 5, a signal for increasing the current input from the inverter power supply 1 to the inverter 3 when the output voltage of the inverter power supply 1 lowers. The output power of the inverter power supply 1, that is, the input power of the inverter 3 thus stabilizes.

A case where the input voltage of the inverter 3 rises includes not only a case where the input current increases with the rise in the input voltage, but also a case where the impedance of the inverter 3 and the fluorescent tube 4 decreases at substantially the same time as the rise in the input voltage.

In particular, if only the input current is detected, the rise in input power cannot be detected even if the input voltage is raised when the input current is substantially constant, but the input power of the inverter 3 can be stabilized when controlling the input current by detecting the input voltage. The output power of the inverter 3 thus stabilizes.

Therefore, the output power of the inverter power supply 1, that is, the input power of the inverter 3 stabilizes by arranging the power stabilizing unit 2 between the inverter power supply 1 and the inverter 3, whereby the change in luminance of the fluorescent tube 4 reduces and the flickering of the backlight 20 reduces.

Although not shown, a control transistor is arranged between the power stabilizing unit 2 and the inverter 3, so that an illumination level of the fluorescent tube 4 can be regulated with the control transistor.

Figure 2:
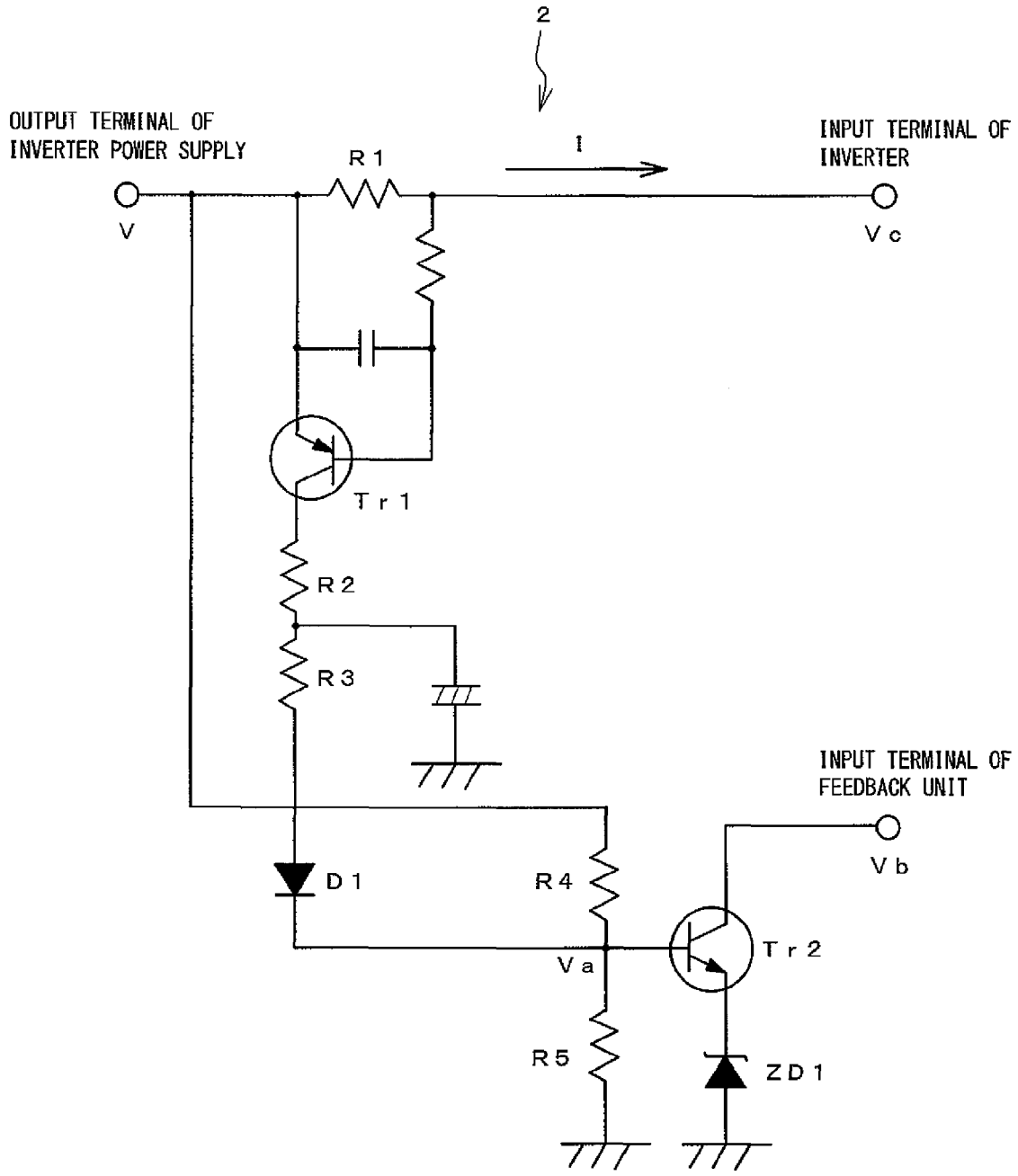
FIG. 2 is a circuit diagram of a power stabilizing unit.

FIG. 2 is a circuit diagram of the power stabilizing unit. The power stabilizing unit 2 is arranged between the inverter power supply 1 and the inverter 3, and can provide a signal for performing the feedback control to the feedback unit 5.

Suppose a first transistor Tr1 and a second transistor Tr2 are turned OFF, and an output terminal voltage V of the inverter power supply 1 is a DC constant voltage.

A resistor R1 is arranged between the inverter power supply 1 and the inverter 3. The voltage across the resistor R1 rises when the current I flowing between the inverter power supply 1 and the inverter 3 increases. When the voltage across the resistor R1 rises, a base-emitter voltage of the first transistor Tr1 rises, thereby turning ON the first transistor Tr1.

In this case, if the impedance of the load of the inverter power supply 1, that is, the inverter 3 and the fluorescent tube 4 decreases and the current I increases, the first transistor Tr1 is turned ON and a collector current flows in the first transistor Tr1, and thus the voltage on a resistor R5 connected between the base and the emitter of the second transistor Tr2 rises. The second transistor Tr2 is then also turned ON.

The voltage Va on the resistor R5, and the sum of the base-emitter voltage of the second transistor Tr2 and the zener voltage of a Zener diode ZD1 are the same.

The input terminal voltage Vb of the feedback unit 5 is higher than the Zener voltage of the Zener diode ZD1 if the second transistor Tr2 is not turned ON, while the input terminal voltage Vb of the feedback unit 5 becomes the same as the Zener voltage if the second transistor Tr2 is turned ON.

Therefore, when the current flowing from the inverter power supply 1 to the inverter 3 increases, a signal for limiting the current is provided to the feedback unit 5 and a feedback control for reducing the output current of the inverter power supply 1 is performed based on the signal.

On the other hand, when the current flowing from the inverter power supply 1 to the inverter 3, that is, the current I flowing through the resistor R1 decreases, the first transistor Tr1 and the second transistor Tr2 are turned OFF. The input terminal voltage Vb of the feedback unit 5 then rises, the signal is provided to the feedback unit 5, and the feedback control is performed so that the current of the inverter power supply 1 increases.

Now consider a case where the voltage of the inverter power supply 1 rises without increase of the current of the inverter power supply 1, that is, the output voltage of the inverter power supply 1 rises at substantially the same time as the increase in impedance of the load such as the inverter 3 and the fluorescent tube 4.

In this case as well, the first transistor Tr1 and the second transistor Tr2 are assumed to be turned OFF. As the voltage of the inverter power supply 1 rises, the base-emitter voltage of the second transistor Tr2 rises, thereby turning ON the second transistor Tr2, and the input terminal voltage Vb of the feedback unit 5 lowers. Therefore, the signal for controlling the current is provided to the feedback unit 5, and the feedback control of the inverter power supply 1 is performed. The feedback control of the input power of the inverter 3 based on the detection of the input voltage of the inverter 3 is carried out by limiting the input current of the inverter 3. Similarly, when the input voltage of the inverter 3 lowers, the feedback control is carried out so that the input current of the inverter 3 increases. The change in luminance of the fluorescent tube 4 thereby reduces.

Figure 3:
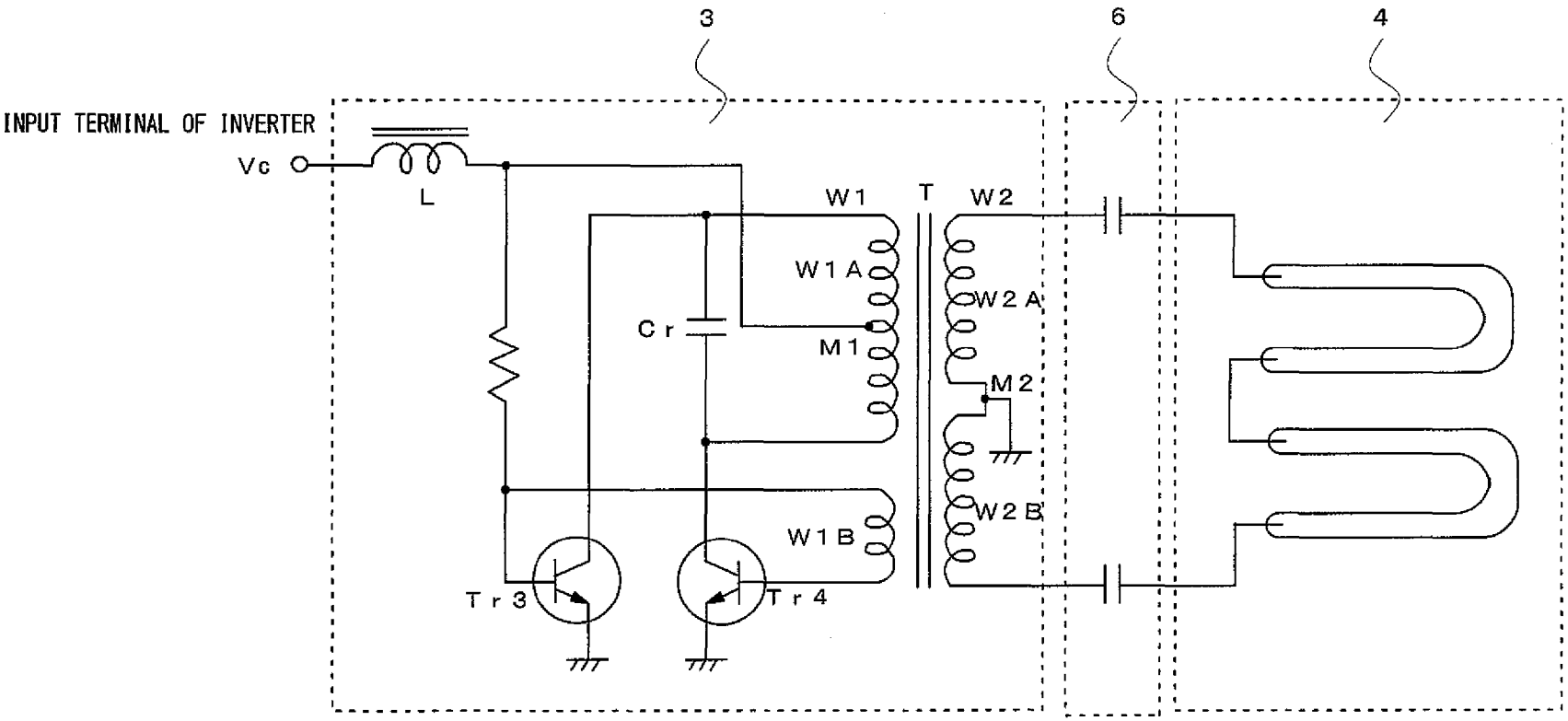
FIG. 3 is a diagram showing an inverter and a fluorescent tube.

FIG. 3 is a diagram showing the inverter and the fluorescent tube according to the embodiment of the present invention.

As shown in FIG. 3, the inverter 3 is a self-oscillation type, and is connected to the fluorescent tube 4 by way of a ballast capacitor 6. The CCFL is used for the fluorescent tube 4. The fluorescent tube 4 has negative resistance characteristics in the practical range. The ballast capacitor 6 stabilizes the lighting of the fluorescent tube 4 by limiting a high frequency current flowing in the fluorescent tube 4.

The inverter 3 includes a choke coil L, a transformer T, a resonance capacitor Cr, transistors Tr3 and Tr4. The inverter 3 is divided to a primary side and a secondary side by the transformer T. A primary winding W1 arranged on the primary side of the transformer T is divided to a main winding W1A and a drive winding W1B. An intermediate tap M1 of the main winding W1A is connected to the input terminal of the inverter 3 by way of the choke coil L, the input terminal voltage of the inverter 3 being Vc. A secondary winding W2 arranged on the secondary side of the transformer T has the middle point M2 grounded, and is divided to a first secondary winding W2A and a second secondary winding W2B.

When the DC voltage Vc, which is the output of the power stabilizing unit 2, is applied to the input terminal of the inverter 3, the transistors Tr3 and Tr4 are alternately conducted by the current from the drive winding W1B and self-oscillate. The current flowing from the intermediate tap M1 to one side of the main winding W1A and the current flowing to the other side of the main winding W1A alternately flows, and the high frequency voltage generates at the secondary winding W2. The ballast capacitor 6 stabilizes the current flowing in the fluorescent tube 4.

If the impedance of the load of the inverter power supply 1, that is, the inverter 3 (particularly the resonance capacitor Cr and the transformer T in the inverter 3), the ballast capacitor 6, or the fluorescent tube 4 varies, the input current of the inverter 3 also changes, but the power input to the inverter 3 stabilizes and variation in luminance of the fluorescent tube 4 reduces by arranging the power stabilizing unit 2 in the fluorescent tube power supply 10.

The present invention can adopt various embodiments other than the embodiment described above. For instance, in the aforementioned embodiment, the PNP transistor is used for the first transistor Tr1 in the power stabilizing unit 2, but the circuit may be configured so as to use the NPN transistor. The NPN transistors Tr3 and Tr4 used in the inverter 3 may be MOSFETs. The tube is not limited a CCFL as long as being the fluorescent tube. That is, the power stabilizing unit 2, the inverter 3, and the like used in the backlight 20 may be of any circuit configuration or circuit element within the scope not departing from the context of the present invention, and the circuit element can be appropriately added, changed, or removed.

What is claimed is:

1. A fluorescent tube power supply comprising;

an inverter power supply configured to output a DC voltages;

an inverter configured to convert an output of the inverter power supply to an AC;

a power stabilizing unit configured to stabilize a power input to the inverter and arranged between the inverter power supply and the inverter; and a feedback unit configured to perform feedback control of the inverter power supply based on an output signal of the power stabilizing unit, wherein the power stabilizing unit comprises a first transistor, a second transistor, a first resistor, a second resistor, and a zener diode, the first resistor is disposed between the inverter power and the inverter, the second resistor is disposed between a base and an emitter of the second transistor, and the zener diode is connected to the emitter of the second transistor.

2. The fluorescent tube power supply according to claim 1, wherein when the DC voltage is constant and current flowing from the inverter power supply to the inverter increases, the first transistor is turned ON by an increase in voltage across the first resistor, and the second transistor is turned ON by an increase in voltage across the second resistor, and the voltage across the second resistor becomes equal to a sum of a base-emitter voltage of the second transistor and a zener voltage of the zener diode.

* * * * *